US005466189A

United States Patent [19]

Deutsch et al.

[11] Patent Number: 5,466,189

[45] Date of Patent: Nov. 14, 1995

[54] CLEANER FOR A ROTATING SCREEN ON A HARVESTER

[75] Inventors: Timothy A. Deutsch, Newton; Lowell H. Neumeyer, Des Moines, both of Iowa

[73] Assignee: Deere & Company, Moline, Ill.

[21] Appl. No.: 292,667

[22] Filed: Aug. 18, 1994

[51] Int. Cl.[6] ..... A01F 12/54

[52] U.S. Cl. ..... 460/100; 55/290; 460/119

[58] Field of Search ..... 460/100, 117, 460/119; 56/30, 31, 32, 28, DIG. 8, 12.8; 55/289, 290, 267, 400

[56] References Cited

U.S. PATENT DOCUMENTS

| | | | |
|---|---|---|---|
| 3,837,149 | 9/1974 | West et al. | 55/269 |
| 4,153,436 | 5/1979 | Cozine et al. | 55/290 |
| 4,233,040 | 11/1980 | Vogelaar et al. | 55/269 |
| 4,443,236 | 4/1984 | Peiler | 55/294 X |
| 4,542,785 | 9/1985 | Bagnall et al. | 165/95 |
| 4,906,262 | 3/1990 | Nelson et al. | 55/290 |
| 5,042,237 | 8/1991 | Sanderson | 56/10.2 |
| 5,183,487 | 2/1993 | Lodico et al. | 55/289 |

*Primary Examiner*—Terry Lee Melius

[57] ABSTRACT

A self-cleaning device for filtering air in a harvester includes a venturi ejector connected to a source of pressurized air which, in a cotton harvester, includes the cotton handling system blower. The ejector includes nozzle, a vacuum chamber shaped to minimize dead air zones and eddy currents, and a diffuser section. The vacuum chamber is supported near a rotating air inlet screen to vacuum debris from the inlet side of the screen. The debris is drawn into the negative pressure air stream upstream of the nozzle and is positively directed away from the engine compartment and other components on the harvester. The engine cooling fan receives only screened air, and the use of a source of air which is independent of the cooling fan, as well as any separate screen cleaning fan, helps to retain maximum engine cooling capacity.

20 Claims, 5 Drawing Sheets

Fig. 8
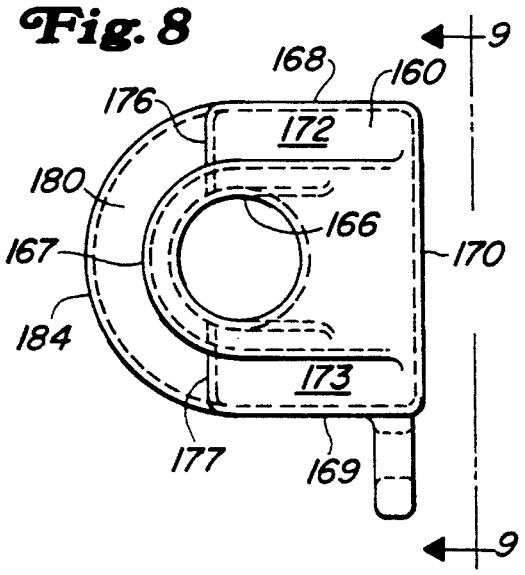
Fig. 7
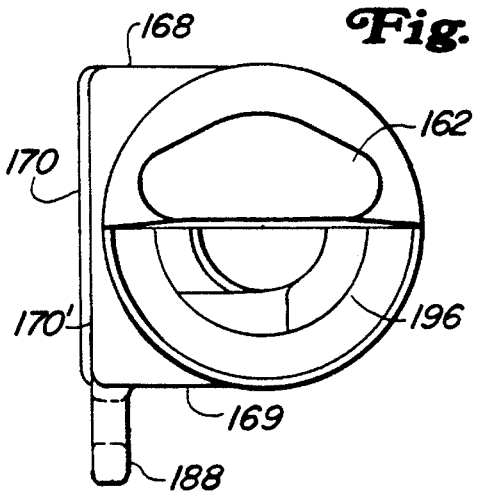
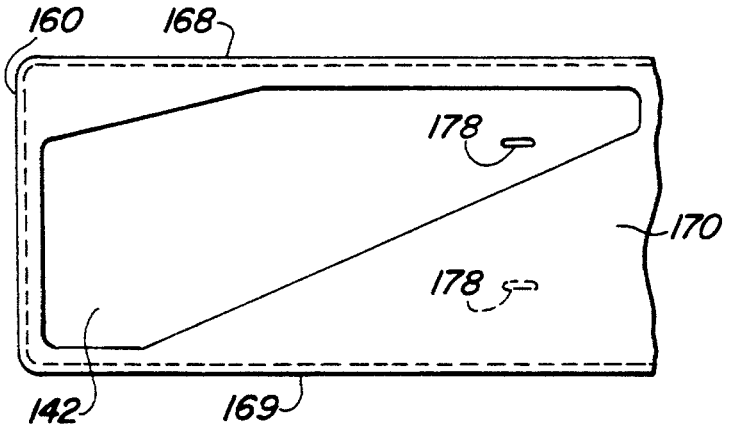
Fig. 9
Fig. 10
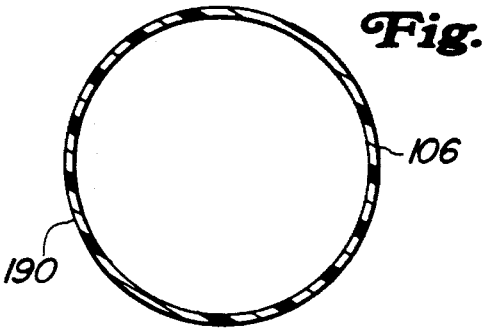
Fig. 11
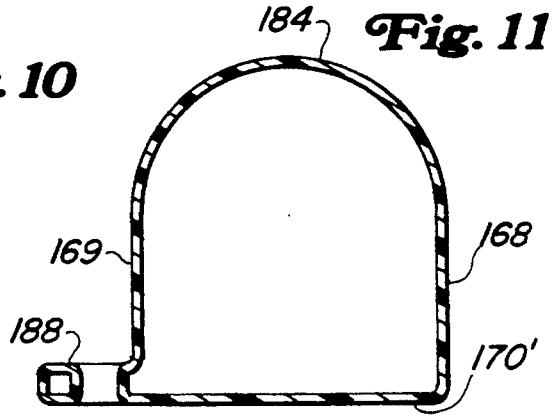
Fig. 13
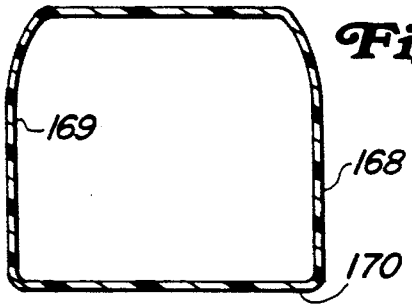
Fig. 12
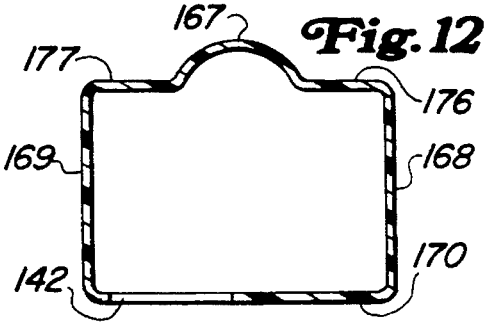

CLEANER FOR A ROTATING SCREEN ON A HARVESTER

BACKGROUND OF THE INVENTION

1. Field of the Invention

The present invention relates generally to cooling air flow devices for agricultural harvesters such as cotton pickers and strippers, and, more specifically, to a cleaning device for a rotating screen air cleaner on such harvesters.

2. Related Art

Agricultural combines and cotton harvesters operate in severe conditions with much dust and plant debris. The hydraulic oil, air conditioner systems, and internal combustion engines of these harvesters require a large volume of partially filtered air for proper cooling. A self-cleaning, rotating inlet screen located adjacent an engine compartment has been employed to remove chaff, leaves and other large particulate matter from the cooling air stream to avoid blockages in the heat exchangers behind the screen. Such devices are shown, for example, in U.S. Pat. Nos. 5,183,487; 4,906,262; 4,542,785; 4,233,040; and 3,837,149.

Various types of vacuum devices, some in combination with shear bars to break up trash into smaller pieces such as shown in the aforementioned U.S. Pat. No. 4,233,040, are available to clean the screen. Often these types of devices fail to eliminate screen plugging problems, especially in cotton harvesters wherein cotton lint can ball up adjacent the screen cleaner. Most of the available devices rely primarily on vacuum, making them prone to clogging, and removal of the screen debris a substantial distance from the harvester area often is not possible. Problems of inadequate debris removal are particularly acute in cotton pickers and strippers where the characteristics of cotton lint and leaves causes such debris to build up quickly and easily on areas of the harvester. Cotton trash that bunches up near the trash ejection area often cannot be removed by the shear bars, and build-ups ultimately disable the cleaning system.

Many of the cleaning systems rely on direct vacuum from the engine cooling fan which reduces cooling capacity and circulates trash through the engine compartment. Systems such as shown in U.S. Pat. No. 4,542,785 require a separate fan, and trash removed from a fixed screen in the system must be passed through the fan.

BRIEF SUMMARY OF THE INVENTION

It is therefore an object of the present invention to provide an improved self-cleaning rotary screen device for a harvester which overcomes most or all of the above-mentioned problems. It is a further object to provide such an improved device which reduces trash build-up around the engine as well as around other areas of the harvester.

It is a further object of the present invention to provide an improved self-cleaning rotary screen device for a harvester which can operate efficiently in most all trash conditions including those typical in a cotton harvesting environment. It is a further object to provide such a device which avoids bunching of trash between the screen and the trash ejection area.

It is yet another object to provide an improved self-cleaning rotary screen device which effectively removes trash from the harvester using a source of positive air pressure. It is still another object to provide such a device wherein the trash does not have to pass through a fan.

It is still another object of the present invention to provide an improved self-cleaning rotary screen device for a harvester that effectively utilizes positive pressure air to clean the screen. It is a further object to provide such a device which does not reduce engine cooling capacity. It is still another object to provide such a device which utilizes the positive pressure air to remove lint and other debris a substantial distance from the engine and other systems on the harvester.

A self-cleaning device for filtering air in a harvester constructed in accordance with the teachings of the present invention includes a venturi ejector connected to a source of pressurized air which, in a cotton harvester, includes the cotton handling system blower so that a separate fan for the air cleaning system is obviated. The ejector includes nozzle, vacuum chamber and diffuser section and is mounted with the vacuum chamber near a conventional rotating air inlet screen to vacuum debris from the inlet side of the screen. The debris is drawn into the negative pressure air stream upstream of the nozzle and is positively directed away from the engine compartment and other components on the harvester. The cooling radiator and fan receive only screened air which is directed into the engine compartment, and the use of a source of air for the ejector which is independent of the cooling fan helps to retain maximum fan cooling capacity. Trash is positively ejected from the harvester area without passing through a fan. The engine compartment and areas of the harvester adjacent the ejector output remain relatively free of lint and trash.

The ejector includes a housing which is shaped to generally have constant air speed within all sections of the vacuum chamber. The housing provides smooth, efficient air flow and minimizes dead air zones and eddy currents.

These and other objects, features and advantages of the present invention will become apparent to one skilled in the art upon reading the following detailed description in view of the drawings.

BRIEF DESCRIPTION OF THE DRAWINGS

FIG. 7 is a view taken along lines 7—7 of FIG. 5.

FIG. 8 is a view taken along lines 8—8 of FIG. 5.

FIG. 9 is a view taken along lines 9—9 of FIG. 8.

FIG. 10 is a sectional view taken along lines 10—10 of FIG. 6.

FIG. 11 is a sectional view taken along lines 11—11 of FIG. 6.

FIG. 12 is a sectional view taken along lines 12—12 of FIG. 6.

FIG. 13 is a sectional view taken along lines 13—13 of FIG. 6.

DETAILED DESCRIPTION OF THE DRAWINGS

Figure 1:
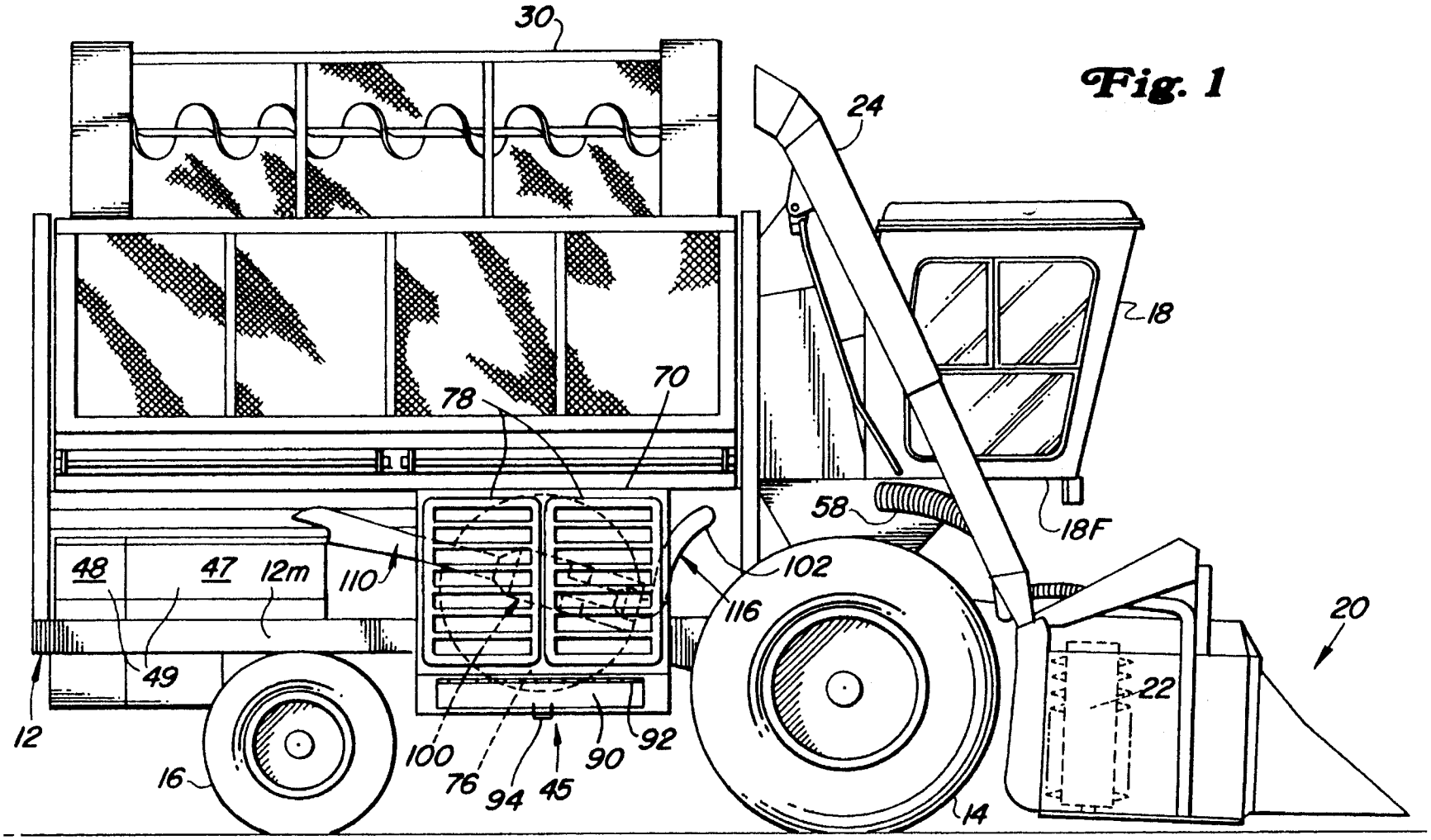
FIG. 1 is a side view of a harvester with a rotary screen air cleaning device attached thereto.
Figure 2:
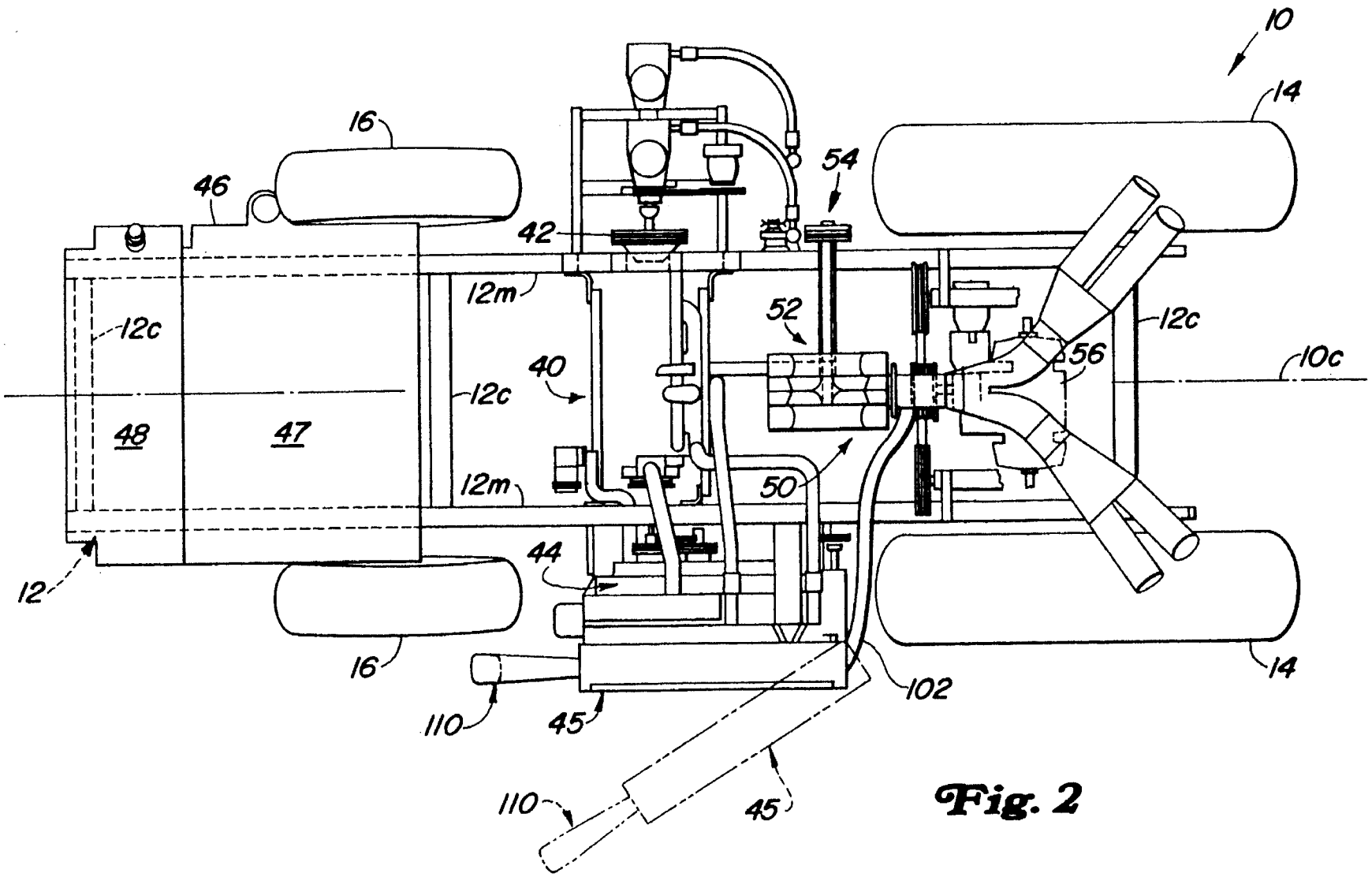
FIG. 2 is a top view of the harvester of FIG. 1 with portions removed to better show the routing of the air duct system which provides a source of positive air pressure to the cleaning device.

Referring now to FIGS. 1 and 2, therein is shown a cotton harvester 10 having a fore-and-aft extending main frame 12 with main side frame beams 12*m* and a plurality transverse connecting members 12*c*. The frame 12 is generally rectangular in configuration and is supported horizontally above the ground on forward drive wheels 14 and aft steerable wheels 16. A cab 18 is centered between the drive wheels 14 and includes floor structure 18*f*. A plurality of row units 20 are supported from the forward end of the frame 12 in transversely spaced relationship for vertical movement between transport and field-working positions by a conventional lift system (not shown). Each row unit houses a conventional cotton picking structure including spindle drums 22 rotatable about upright axes for moving columns of spindles into picking relationship with cotton plants. Cotton conveying ducts 24 extend upwardly and rearwardly from the units 20 to a cotton basket 30 carried on the frame 12 behind the cab 18.

The harvester 10 is powered by an engine 40 (FIG. 2) mounted transversely on the frame 12 between the front drive wheels 14 and the rear wheels 16. A main drive sheave 42 mounted on the engine crankshaft projects outwardly from the side frame beam 12*m* on one side (the left side as shown in FIG. 2) of the frame 12. Several heat exchangers 44, such as the engine radiator, an oil cooler and air conditioner condenser coils, are supported on the opposite or right side of the frame 12 outwardly of the beam 12*m* between the front and rear wheels 14 and 16. A mechanical air cleaner 45, preferably a self-cleaning rotary screen cleaner generally of the type utilized on the John Deere Model 9000 Combine and similar to that shown in U.S. Pat. Nos. 5,183,487 and 4,906,262, is positioned outwardly of the heat exchangers 44 to filter the cooling air.

A water or cleaning solution tank 47 is supported near the aft end of the frame 12. A fuel tank 48 is also mounted on the aft end of the frame 12 closely adjacent the aft face of the tank 46. The water tank 46 and fuel tank 48 lie substantially entirely behind the axles of the wheels 16 and include transverse ledges 49 supported on the tops of the beams 12*m*. The tank 46 is L-shaped (FIG. 1) and extends rearwardly from a location above the axles of the wheels 16 and downwardly to a lowermost section below the beam 12*m*. The fuel tank 48 includes a forward face abutting against the rear face of the tank 46 and also extends below the frame 12. When filled or partially filled, the tanks have a relatively low center of gravity.

An air system 50 includes a centrifugal fan 52 (FIG. 2) supported by the frame 12 generally on the centerline 10*c* of the harvester forward of the engine 40 and behind the cab 18. A fan drive 54, partially located outwardly of the frame 12, operably connects the engine sheave 42 and the fan 52. A centralized air distribution chamber 56 is connected to an outlet 57 of the fan 52 and to flexible air tubings 58 adjacent the cab floor 18f to distribute air to the cotton conveying ducts 24.

The Air Cleaner Structure

The cleaner 45 includes a door 70 (FIG. 3) pivotally connected at hinge locations 72 to the frame 12 for swinging between an open access position (broken lines of FIG. 2) and a closed position (solid lines of FIG. 2) adjacent the heat exchangers 44. A rotary screen 76 is mounted for rotation in a circular opening in the door 70 so that cooling air moving inwardly towards the heat exchangers 44 must pass through the screen 76. Grill structure 78 is removably supported by the door 70.

An endless belt 80 connected to drive structure 82 rotates the screen 76 about a screen axis indicated generally at 84. The belt 80 and the drive structure 82 are so arranged that the door 70 can be opened and closed without disconnecting drive to the screen 76. Reference may be had to the aforementioned U.S. Pat. No. 4,906,262 for further details of the screen 76 and drive 82.

A clean-out door 90 (FIG. 1) is hinged at 92 to the lower portion of the door 70 and is spring-loaded to a normally closed position. A handle 94 centrally located on the clean-out door 90 so the operator can pull the door open against the bias.

Air housing structure 100 is connected by an air conduit 102 to a source of positive pressure on the harvester, preferably the outlet 57 of the fan 52. The housing structure 100 provides a differential pressure across the screen 76 with the pressure on the back side of the screen (the side opposite the debris-catching side) being relatively higher than that on the debris-catching side (the outside of the screen) for removing lint and other trash from the outside of the screen. The housing structure 100 includes a venturi area 106 for creating a vacuum by a venturi effect using the positive pressure air from an available harvester fan. The housing structure 100 opens rearwardly closely adjacent the outside of the screen 76 so the vacuum created by the venturi vacuums lint and other debris from the screen. A housing outlet 110 opens directly to atmosphere so the vacuum-producing air entrained with the debris is directed away from the screen and the engine compartment without having to pass through the engine compartment or a fan.

Figure 3:
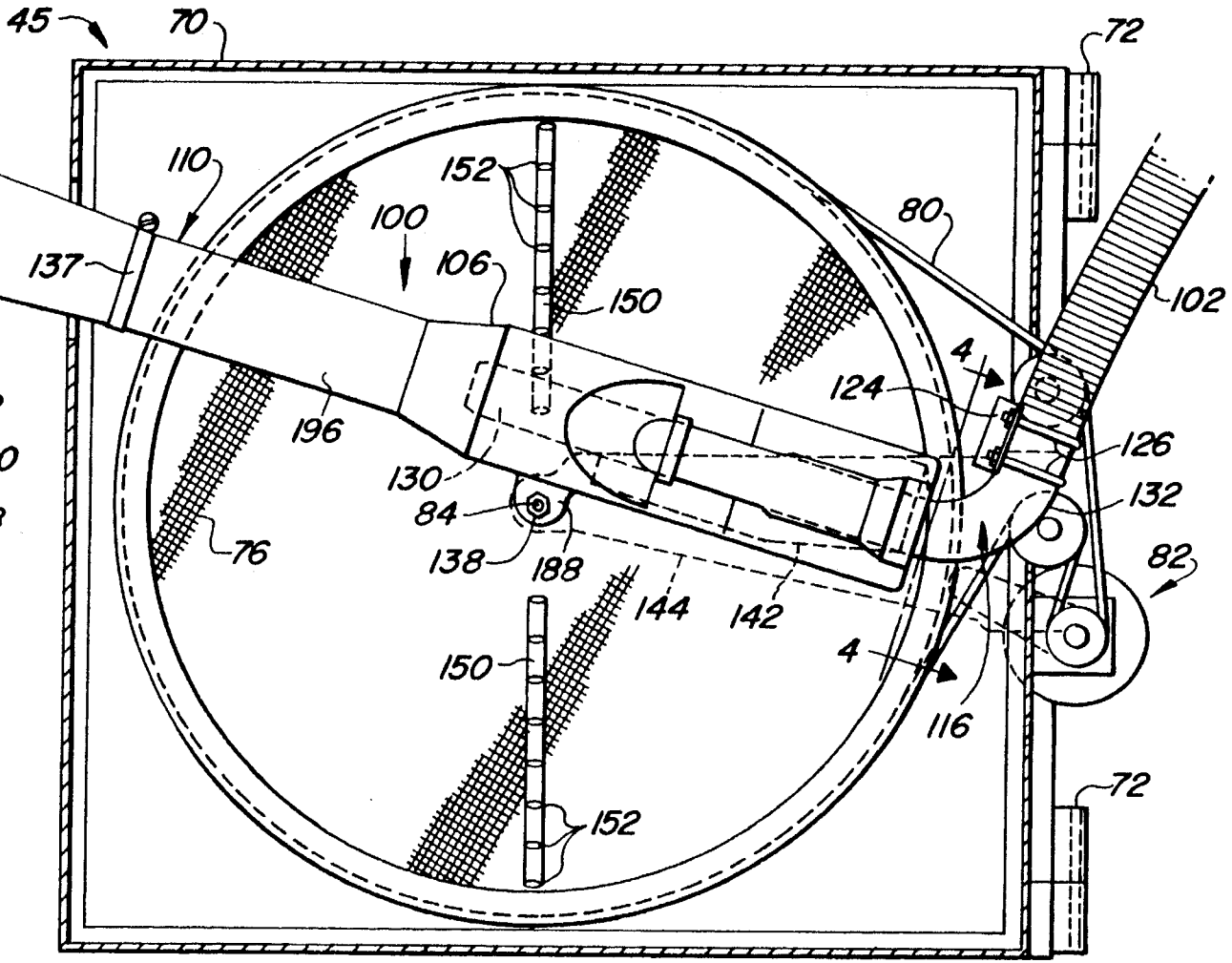
FIG. 3 is an enlarged front view, partially in section, of the rotary screen air cleaning device of FIG. 1.
Figure 4:
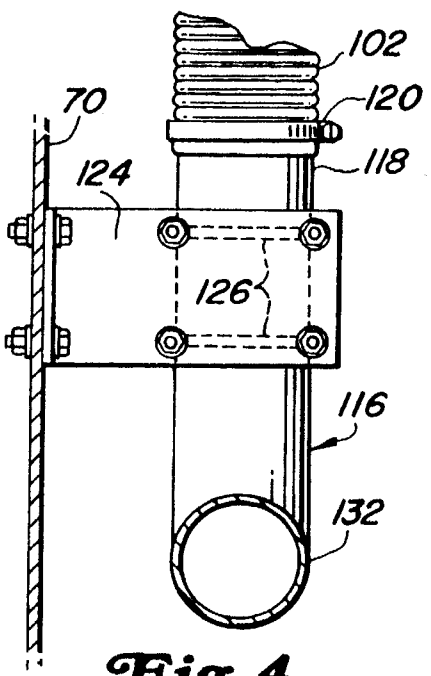
FIG. 4 is an enlarged view of the support bracket for screen cleaning device taken essentially along lines 4—4 of FIG. 3.
Figure 5:
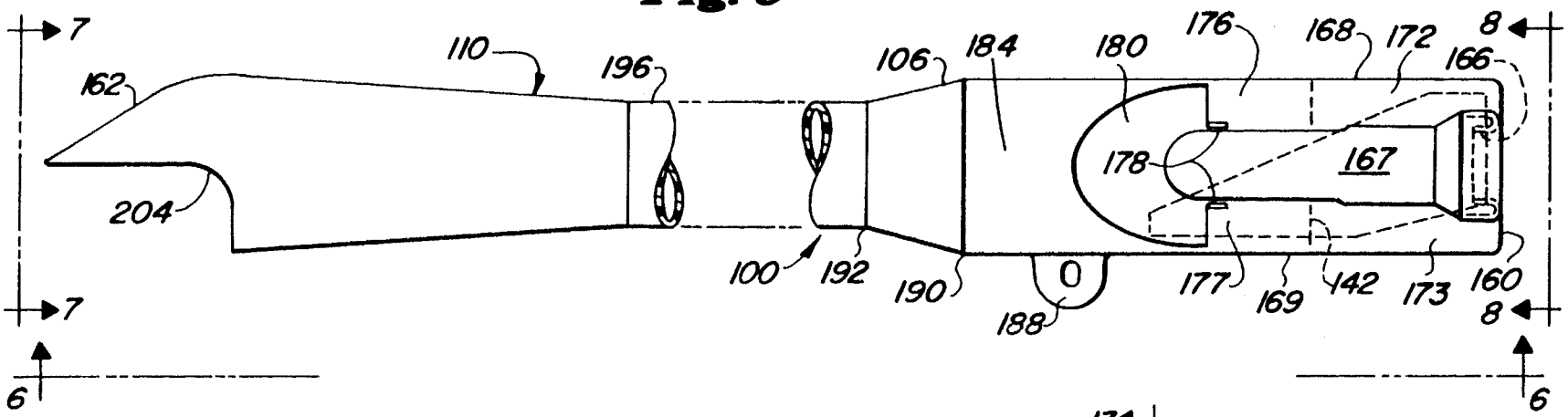
FIG. 5 is an enlarged front view of the screen cleaning device shown in FIG. 3.
Figure 6:
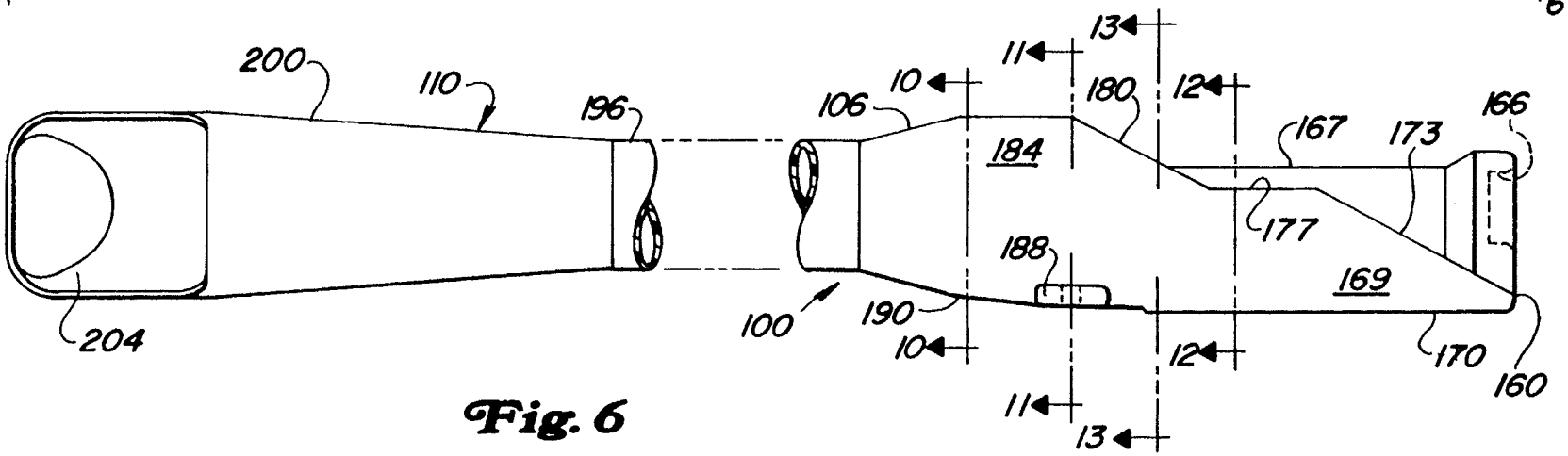
FIG. 6 is a bottom view of the device taken along lines 6—6 of FIG. 5.

Referring now to FIGS. 3 and 4, therein is shown a venturi nozzle tube 116 having an upper inlet end 118 connected by a hose clamp 120 to the outlet of the air conduit 102. The upper end 118 is secured to the door 70 by an angle bracket 124 and a pair of U-bolts 126. A nozzle end 130 extends upwardly and rearwardly along the screen 76 from a bend location 132 below the bracket 124. The bracket 124 includes elongated slots so the distance between the tube 116 and the plane of the screen 76 can be adjusted. The diameter of the nozzle end 130 decreases slightly from the diameter of the remainder of the tube 116 and terminates rearwardly and above the axis of rotation 84 of the screen 76.

The housing structure 100 is slidably received over the tube 116 downstream of the bend location 132 with the venturi area 106 positioned adjacent the nozzle end 130. A hose clamp 136 secures the housing structure 100 to the tube 116 at a central location between the bend location 132 and the nozzle end 130. A second clamp 137 supports the central portion of the housing outlet 110 from the door 70. A screw, washer and bushing assembly 138 supports the lower, central portion of the housing structure 100 at the axis 84.

The back of the housing structure 100 opens in a vacuum opening 142 at about a 3 o'clock position (FIG. 3) on the face of the screen 76 to communicate the vacuum produced by the venturi to the face. A low pressure cut-off member 144 is located closely adjacent the inside or back side of the screen 76 to generally extend across the area of the back side of the screen adjacent the opening 142 to help retain a positive pressure relative to the opening 142 and release the lint and debris on the screen to the vacuum. The leading edge of the vacuum opening 142 runs substantially parallel to a radial line extending from the axis 84 to the outer edge of the screen 76.

A pair of diametrically opposed rakes 150 are connected to the outer surface of the screen 76 for rotation with the screen about the axis 84. The rakes 150 include axially projecting ribs 152 with flattened tops that pass closely adjacent a flat wall of the housing structure 100, described in detail below, to prevent balling at the leading edge of the housing structure by raking the debris into communication with the vacuum opening 140.

Referring now to FIGS. 5–13, the housing structure 100 will be described in detail. Preferably the structure 100 is of unitary, molded plastic construction and includes a proximate or forward end 160 and a rear or distal deflecting end 162. A venturi nozzle tube receiving flange 166 is formed in the end 160. The forward end of the housing has a rounded top 167 with an inner diameter approximately equal to the outer diameter of the tube 116. Side walls 168 and 169 extend upwardly from a flat, apertured bottom wall 170 which defines the vacuum opening 142. A pair of upwardly and rearwardly inclined wall sections 172 and 173 extend from the side walls 168 and 169, respectively, to junctures with the rounded top 167 and with top sections 176 and 177 which extend a short distance parallel to the bottom wall 170 on either side of the rounded top 167. Slots 178 are formed in the aft ends of the sections 176 and 177 to receive the clamp 136 which centers the nozzle end 130 at the proper location relative to the venturi area 106. An angled wall 180 extends generally parallel to the walls 172 and 173 around the aft end of the rounded top 167 to an enlarged rounded top 184.

A bottom wall 170' extends parallel to but offset slightly outwardly (that is, away from the outer surface of the screen 76) from the wall 170 below the rounded top 184. An attaching member 188 is formed adjacent the wall 169 and the bottom 170' for receiving the bushing assembly 138 that connects the housing structure 100 to the area of the axis 84.

The venturi area 106 has a circular cross section at an area 190 (FIG. 10) which tapers to a smaller diameter cross section at area 192 where the venturi area connects with a generally constant diameter section 196. The section 196 extends rearwardly and defines the forward section of the housing outlet 110. The aft end of the section 196 connects with a tail pipe section 200 that increases in cross section towards a rear discharge area 204 with a downwardly and rearwardly directed opening adjacent the deflecting end 162 for directing expelled material away from the harvester.

The inside of the housing structure 100 is smooth and, in combination with the rear wall structure which angles away from the screen 76 in the direction of the venturi area 106, provides a uniform constant speed air flow without substantial dead spots or eddy currents within the housing. As the high pressure air from the fan 52 exits the venturi nozzle end 130 and expands, a vacuum is created within the housing which vacuums debris from the outer surface of the screen 76 and pulls the debris towards the venturi area 106. The debris is moved into the positive pressure air stream in the section 196 and is forcibly expelled from the outlet 204 away from the harvester. If cotton lint or other debris starts to ball up adjacent the upstream side of the bottom wall 170, the ribs 152 of the rakes 150 will pull the lint into communication with the vacuum opening 147 for removal through the housing structure 100. The wall 170 is preferably maintained substantially parallel to the screen 76 with the tops of the ribs 152 passing closely adjacent the wall 170. Therefore, the rotating screen 76 will be maintained relatively trashfree so that cooling air can freely enter the door 70 and pass through the heat exchangers 44. The bottom wall 170 of the housing structure 100 can be adjusted the desired distance from the screen 76 by loosing the bracket 124 and moving the venturi nozzle tube 116.

Having described the preferred embodiment, it will become apparent that various modifications can be made without departing from the scope of the invention as defined in the accompanying claims.

Claims:

1. In a harvester having a source of pressurized air and operating in an environment laden with material such as lint and debris, the harvester including an engine compartment with a power system in the compartment which is cooled at least in part by a flow of air, the harvester also including a screen for separating the material from the flow of air, a cleaner for removing the material from the screen, comprising:

venturi structure connected to the source of pressurized air and having a high pressure inlet area connected to a source of pressurized air, the pressure at the inlet area being above atmospheric pressure, and a low pressure area located adjacent the screen for vacuuming the material from the screen, the venturi structure including an outlet directing pressurized air away from the screen and propelling the material vacuumed from the screen outwardly from the screen and away from the engine compartment.

2. The invention as set forth in claim 1 wherein the source of pressurized air comprises crop conveying fan structure, and the venturi structure directs air in a path generally parallel to the screen.

3. The invention as set forth in claim 1 including a rake supported for movement relative to the venturi structure to prevent the lint and debris from clumping adjacent the venturi structure.

4. In a harvester having a source of pressurized air and operating in an environment laden with material such as lint and debris, the harvester including an engine compartment with a power system in the compartment which is cooled at least in part by a flow of air, the harvester also including a screen for separating the material from the flow of air, a cleaner for removing the material from the screen, comprising:

venturi structure connected to the source of pressurized air and having a low pressure area located adjacent the screen for vacuuming the material from the screen, the venturi structure including an outlet directing pressurized air away from the screen and propelling the material vacuumed from the screen away from the engine compartment;

a rake supported for movement relative to the venturi structure to prevent the lint and debris from clumping adjacent the venturi structure and wherein the venturi structure includes a flat wall located closely adjacent and generally parallel to the screen, and the rake includes ribs projecting towards the flat wall.

5. The invention as set forth in claim 1 wherein the venturi structure includes a housing having a smooth interior, an input side connected to the source of pressurized air, and an output side exhausting the material, the housing shaped to have a generally constant air speed in the low pressure area and to minimize dead air zones and eddy currents in the low pressure area.

6. In a cotton harvester adapted for operation in an environment laden with material such as cotton lint and debris, the cotton harvester including an engine compartment with a power system in the compartment cooled at least in part by a flow of air, and a crop conveying system having a fan with an air inlet and an air output, the fan providing a source of pressurized air at the output for moving harvested cotton, the harvester also including a screen having an outer debris-catching surface for separating the material from the flow of air, a cleaner for removing the material from outer debris-catching surface of the rotary screen comprising:

air housing structure connected to the fan output for receiving pressurized air above atmospheric pressure and located adjacent the debris-catching side of the screen, the housing structure providing a differential pressure across the screen with a pressure on the side of the screen opposite the debris-catching side relatively higher than that on the debris-catching side of the screen for removing the material from the screen, the housing structure including a housing outlet directing pressurized air away from the screen and conveying the material removed from the screen with the pressurized air above atmospheric pressure in a direction away from the engine compartment.

7. The invention as set forth in claim 6 wherein the air housing structure includes a venturi located on the debris-catching side of the screen and connected to the fan outlet.

8. The invention as set forth in claim 6 wherein the air housing structure is connected to the outlet of the fan and the housing outlet opens to atmosphere downstream of the fan outlet.

9. The invention as set forth in claim 7 wherein the screen comprises a rotatable screen, and further comprising a rake located on the debris-catching side of the screen and rotatable with the screen to prevent material build-up adjacent the air housing structure.

10. In a cotton harvester adapted for operation in an environment laden with material such as cotton lint and debris, the cotton harvester including an engine compartment with a power system in the compartment cooled at least in part by a flow of air, and a crop conveying system having a fan with an air inlet and an air output, the fan providing a source of pressurized air at the output for moving harvested cotton, the harvester also including a screen having an outer debris-catching surface for separating the material from the flow of air, a cleaner for removing the material from outer debris-catching surface of the rotary screen comprising:

air housing structure connected to the fan and located adjacent the screen, the housing structure providing a differential pressure across the screen with a pressure on the side of the screen opposite the debris-catching side relatively higher than that on the debris-catching side of the screen for removing the material from the screen, the housing structure including a housing outlet directing pressurized air away from the screen and conveying the material removed from the screen away from the engine compartment;

wherein the screen comprises a rotatable screen and the air housing structure includes a venturi located on the debris-catching side of the screen and connected to the fan outlet;

a rake located on the debris-catching side of the screen and rotatable with the screen to prevent material build-up adjacent the air housing structure; and wherein the housing structure includes a flat apertured wall defining a plane adjacent and parallel to the screen and a vacuum opening, and wherein the rake includes members projecting closely adjacent to but offset from the plane of the apertured wall.

11. In an agricultural harvester having a source of pressurized air and operating in an environment laden with material such as lint and debris, the harvester including an engine compartment with a power system in the compartment which is cooled at least in part by a flow of air, the harvester also including a screen having an outer debris-catching surface for separating the material from the flow of air, a cleaner for removing the material from outer debris-catching surface of the screen, comprising:

air housing structure connected to the source of pressurized air above atmospheric pressure and located adjacent the screen, the air housing structure providing a differential pressure across the screen with a pressure on the side of the screen opposite the debris-catching side relatively higher than that on the debris-catching side for removing the material from the screen, the housing structure including an outlet directing pressurized air above atmospheric pressure away from the screen and propelling the material removed from the screen in a direction away from the engine compartment.

12. The invention as set forth in claim 11 wherein the housing structure comprises a venturi located adjacent the debris-catching surface for vacuuming material from the debris-catching surface.

13. The invention as set forth in claim 11 including a rake supported for movement relative to the air housing structure to prevent the lint and debris from clumping adjacent the air housing structure.

14. In an agricultural harvester having a source of pressurized air and operating in an environment laden with material such as lint and debris, the harvester including an engine compartment with a power system in the compartment which is cooled at least in part by a flow of air, the harvester also including a screen having an outer debris-catching surface for separating the material from the flow of air, a cleaner for removing the material from outer debris-catching surface of the screen, comprising:

air housing structure connected to the source of pressurized air and located adjacent the screen, the housing structure providing a differential pressure across the screen with a pressure on the side of the screen opposite the debris-catching side relatively higher than that on the debris-catching side for removing the material from the screen, the housing structure including an outlet directing pressurized air away from the screen and propelling the material removed from the screen away from the engine compartment;

wherein the air housing structure comprises a venturi located adjacent the debris-catching surface for vacuuming material from the debris-catching surface; and wherein the housing has a smooth interior and an input side connected to the source of pressurized air and an output side connected to the outlet, the housing having a wall opposite the screen which increases in distance from the screen from the input side to the output side to provide a generally constant air speed within the housing thereby avoiding dead air spaces and eddy currents within the housing.

15. The invention as set forth in claim 12 wherein the outlet includes a deflector directing the pressurized air and material outwardly away from the harvester.

16. The invention as set forth in claim 11 wherein the source of pressurized air includes a harvested crop material handling system fan.

17. The invention as set forth in claim 16 wherein the air housing structure is connected to the source of pressurized air downstream of the system fan so that the propelled material removed from the screen does not pass through the fan.

18. The invention as set forth in claim 13 wherein the screen comprises a rotary screen.

19. The invention as set forth in claim 11 including a pivoting door connected for movement with respect to the engine compartment between an open access position and a closed operating position, and wherein the air housing structure is connected for pivoting with the door.

20. The invention as set forth in claim 19 wherein the pivoting door includes a lowermost clean out door.

* * * * *